US010544701B2

(12) United States Patent
Taxacher et al.

(10) Patent No.: US 10,544,701 B2
(45) Date of Patent: Jan. 28, 2020

(54) TURBINE SHROUD ASSEMBLY

(71) Applicant: GENERAL ELECTRIC COMPANY, Schenectady, NY (US)

(72) Inventors: Glenn Curtis Taxacher, Simpsonville, SC (US); John McConnell Delvaux, Fountain Inn, SC (US); Matthew Troy Hafner, Honea Path, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 288 days.

(21) Appl. No.: 15/623,990

(22) Filed: Jun. 15, 2017

(65) Prior Publication Data

US 2018/0363498 A1 Dec. 20, 2018

(51) Int. Cl.
*F01D 25/04* (2006.01)
*F01D 9/04* (2006.01)

(52) U.S. Cl.
CPC ..... *F01D 25/04* (2013.01); *F01D 9/04* (2013.01); *F05D 2220/32* (2013.01);
(Continued)

(58) Field of Classification Search
CPC . F01D 5/143; F01D 9/04; F01D 9/041; F01D 11/08; F01D 11/14; F01D 11/16; F01D 11/20; F01D 11/22; F01D 25/005; F01D 25/04; F01D 25/24; F01D 25/246; F01D 25/28; F05D 2220/32;
(Continued)

(56) References Cited

U.S. PATENT DOCUMENTS 3,864,056 A * 2/1975 Gabriel ..... F01D 5/08 415/116
4,072,434 A * 2/1978 Homuth ..... F16J 1/12 403/263

(Continued)

FOREIGN PATENT DOCUMENTS

EP 1529926 A2 5/2005
EP 2299061 A2 3/2011

OTHER PUBLICATIONS

Taxacher, et al: "Turbine Component" filed on Aug. 18, 2014 as U.S. Appl. No. 14/461,551 (unpublished application).

*Primary Examiner* — Jason D Shanske
*Assistant Examiner* — Sang K Kim
(74) *Attorney, Agent, or Firm* — McNees Wallace & Nurick LLC

(57) ABSTRACT

A turbine shroud assembly is disclosed including an inner shroud, an outer shroud, a shroud dampening pin, and a biasing apparatus. The inner shroud is adjacent to a hot gas path. The outer shroud is adjacent to the inner shroud and distal from the hot gas path, and includes a channel extending from an aperture adjacent to the inner shroud. The shroud dampening pin is within the channel and contacts the inner shroud, and includes a shaft, a contact surface, and a cap. The shaft is within the channel. The contact surface extends through the aperture in contact with the inner shroud. The cap is distal across the shaft from the contact surface. The biasing apparatus contacts the cap, is driven by a pressurized fluid, and provides a biasing force away from the outer shroud along the shroud dampening pin to the inner shroud through the contact surface.

20 Claims, 3 Drawing Sheets

(52) U.S. Cl.
CPC ..... *F05D 2260/30* (2013.01); *F05D 2260/42* (2013.01); *F05D 2300/175* (2013.01); *F05D 2300/6033* (2013.01)

(58) Field of Classification Search
CPC ..... F05D 2240/11; F05D 2250/611; F05D 2260/30; F05D 2260/42; F05D 2300/175; F05D 2300/6033
See application file for complete search history.

(56) References Cited

U.S. PATENT DOCUMENTS

| | | | | |
|---|---|---|---|---|
| 6,315,519 | B1 | 11/2001 | Bagepalli et al. | |
| 6,726,448 | B2 | 4/2004 | McGrath et al. | |
| 6,758,653 | B2 | 7/2004 | Morrison | |
| 6,942,203 | B2 * | 9/2005 | Schroder | F01D 9/04 267/160 |
| 8,047,773 | B2 | 11/2011 | Bruce et al. | |
| 8,167,546 | B2 | 5/2012 | Shi et al. | |
| 8,272,835 | B2 * | 9/2012 | Smith | F01D 11/22 192/85.59 |
| 2009/0053050 | A1 * | 2/2009 | Bruce | F01D 25/04 415/200 |
| 2016/0017743 | A1 * | 1/2016 | Duguay | F01D 11/08 415/1 |
| 2017/0044923 | A1 | 2/2017 | Roberts et al. | |
| 2017/0051627 | A1 | 2/2017 | Hafner et al. | |

* cited by examiner

TURBINE SHROUD ASSEMBLY

FIELD OF THE INVENTION

The present invention is directed to turbine shroud assemblies. More particularly, the present invention is directed to turbine shroud assemblies wherein the shroud dampening pin is driven by a pressurized fluid.

BACKGROUND OF THE INVENTION

Hot gas path components of gas turbines are subjected to high air loads and high acoustic loads during operation which, combined with the elevated temperatures and harsh environments, may damage the components over time. Both metal and ceramic matrix composite ("CMC") components may be vulnerable to such damage, although CMC components are typically regarded as being more susceptible than metallic counterparts, particularly where CMC components are adjacent to metallic components.

Damage from air loads and acoustic loads may be pronounced in certain components, such as turbine shrouds, which include a hot gas path-facing sub-component which is not fully secured to, but in contact with, a non-hot gas path-facing sub-component. By way of example, due to air loads and acoustic loads, the inner shroud of a turbine shroud assembly may vibrate against and be damaged by the outer shroud during operation. Further, loading an inner shroud to dampen air loads and acoustic loads with a spring may be subject to spring failure under the operating conditions, particularly temperature, of gas turbines.

BRIEF DESCRIPTION OF THE INVENTION

In an exemplary embodiment, a turbine shroud assembly includes an inner shroud, an outer shroud, a shroud dampening pin, and a biasing apparatus. The inner shroud is arranged to be disposed adjacent to a hot gas path. The outer shroud is adjacent to the inner shroud and arranged to be disposed distal from the hot gas path across the inner shroud, and includes a channel extending from an aperture adjacent to the inner shroud. The shroud dampening pin is disposed within the channel and in contact with the inner shroud, and includes a shaft, a contact surface, and a cap. The shaft is disposed within the channel. The contact surface is disposed at a first end of the shaft and extends through the aperture in contact with the inner shroud. The cap is disposed at a second end of the shaft distal from the first end of the shaft. The biasing apparatus is in contact with the cap, is driven by a pressurized fluid, and provides a biasing force away from the outer shroud along the shroud dampening pin to the inner shroud through the contact surface.

Other features and advantages of the present invention will be apparent from the following more detailed description of the preferred embodiment, taken in conjunction with the accompanying drawings, which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided are exemplary turbine shroud assemblies. Embodiments of the present disclosure, in comparison to articles not utilizing one or more features disclosed herein, decrease costs, improve mechanical properties, increase component life, decrease maintenance requirements, eliminate spring failure, or combinations thereof.

Figure 1:
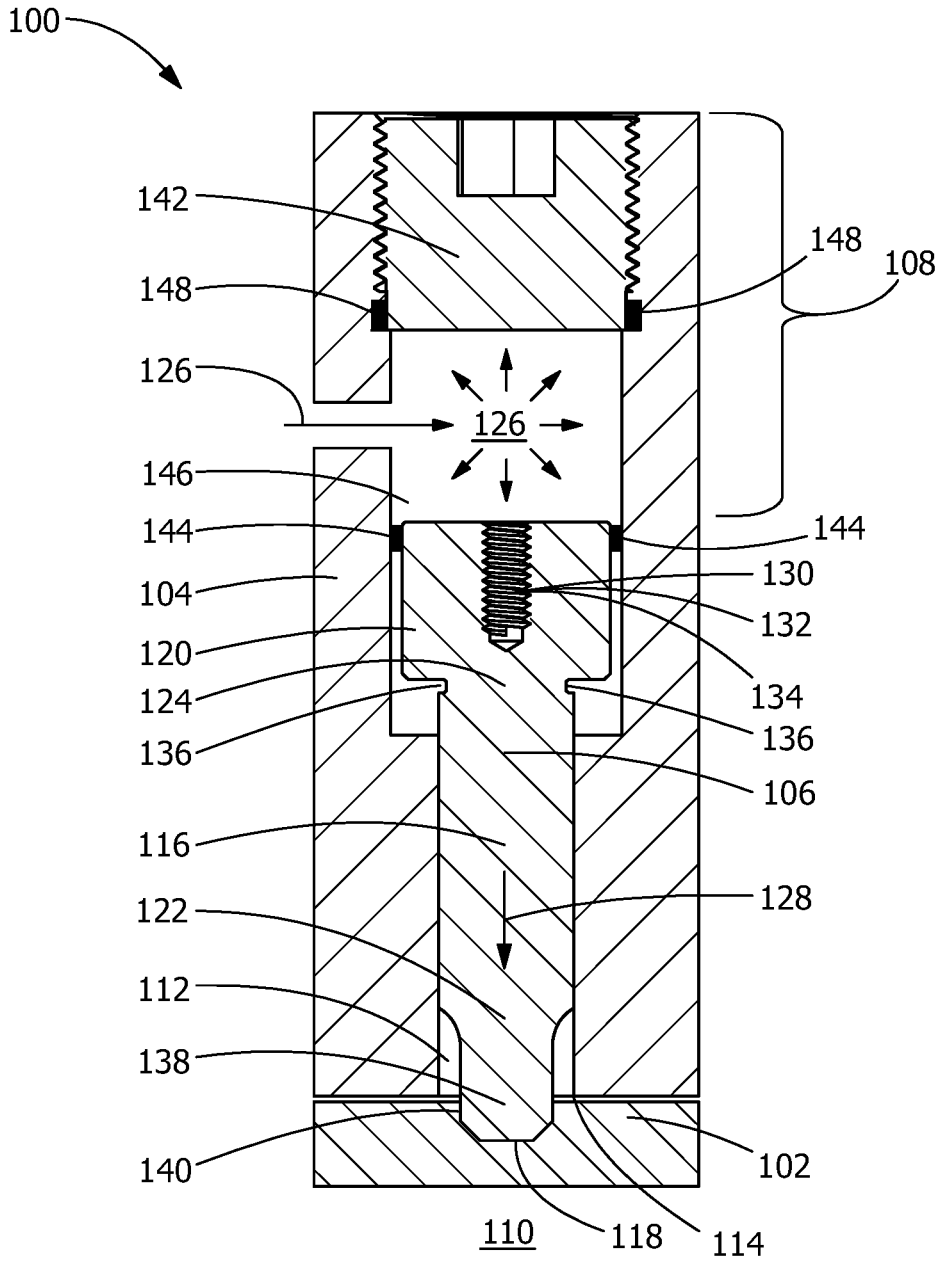
FIG. 1 is a cross-sectional view of a turbine shroud assembly having a pressurized cavity, according to an embodiment of the present disclosure.
Figure 2:
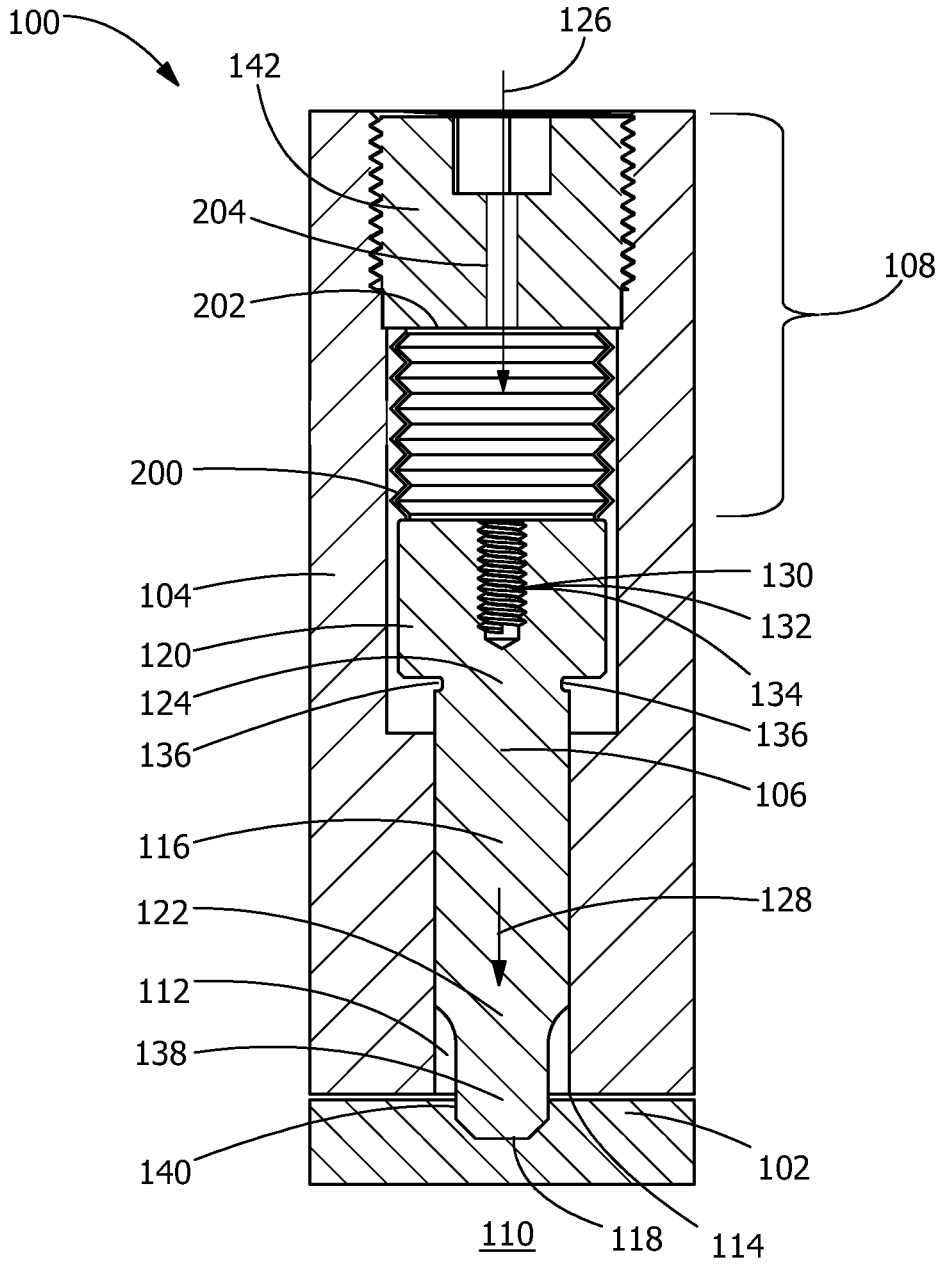
FIG. 2 is a cross-sectional view of a turbine shroud assembly having a bellows, according to an embodiment of the present disclosure.
Figure 3:
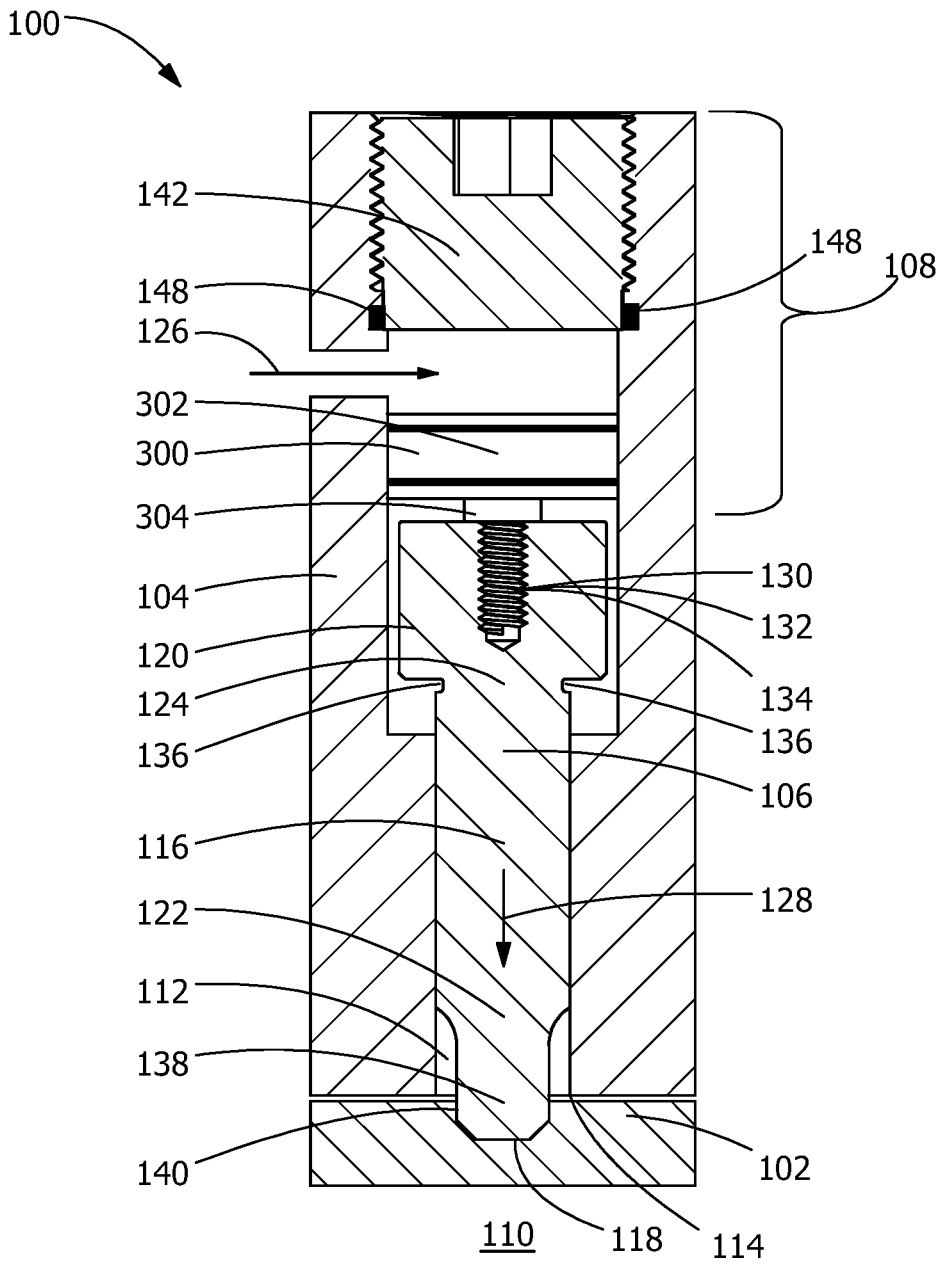
FIG. 3 is a cross-sectional view of a turbine shroud assembly having a thrust piston, according to an embodiment of the present disclosure.

Referring to FIGS. 1-3, in one embodiment, a turbine shroud assembly 100 includes an inner shroud 102, an outer shroud 104, a shroud dampening pin 106, and a biasing apparatus 108. The inner shroud 102 is arranged to be disposed adjacent to a hot gas path 110. The outer shroud 104 is adjacent to the inner shroud 102 and arranged to be disposed distal from the hot gas path 110 across the inner shroud 102. The outer shroud 104 includes a channel 112 extending from an aperture 114 adjacent to the inner shroud 102. The shroud dampening pin 106 is disposed within the channel 112 and in contact with the inner shroud 102. The shroud dampening pin 106 includes a shaft 116, a contact surface 118, and a cap 120. The contact surface 118 is disposed at a first end 122 of the shaft 116. The cap 120 is disposed at a second end 124 of the shaft 116 distal from the first end 122 of the shaft 102. The shaft 116 is disposed within the channel 112, and the contact surface 118 of the shroud dampening pin 106 extends through the aperture 114. The biasing apparatus 108 is in contact with the cap 120, is driven by a pressurized fluid 126 and provides a biasing force 128 away from the outer shroud 104 along the shroud dampening pin 106 to the inner shroud 102 through the contact surface 118. The turbine shroud assembly 100 may include a plurality of shroud dampening pins 106 disposed within a plurality of channels 112.

The cap 120 may include an extraction interface 130. In one embodiment, the extraction interface 130 includes a bore 132. The bore 132 may be a threaded bore 134 or may include any suitable securing feature for a tool to exert a pulling force upon.

In one embodiment, the shaft 116 includes a circumferential relief groove 136 directly adjacent to the cap 120.

The inner shroud 102 may include any suitable material composition, including, but not limited to, CMCs, aluminum oxide-fiber-reinforced aluminum oxides (Ox/Ox), carbon-fiber-reinforced silicon carbides (C/SiC), silicon-carbide-fiber-reinforced silicon carbides (SiC/SiC), carbon-fiber-reinforced silicon nitrides ($C/Si_3N_4$), silicon-carbide-fiber-reinforced silicon nitrides ($SiC/Si_3N_4$), superalloys, nickel-based superalloys, cobalt-based superalloys, INCONEL 718, INCONEL X-750, cobalt L-605, or combinations thereof.

The outer shroud 104 may include any suitable material composition, including, but not limited to, iron alloys, steels, stainless steels, carbon steels, nickel alloys, superalloys, nickel-based superalloys, INCONEL 738, cobalt-based superalloys, or combinations thereof.

The shroud dampening pin 106 may include any suitable material composition, including, but not limited to, high alloy steels, CrMo steels, superalloys, nickel-based superalloys, cobalt-based superalloys, cobalt L-605, CRUCIBLE 422, INCONEL 718, INCONEL X-750, or combinations thereof.

As used herein, "high alloy steel" refers to a steel that, in additional to carbon, iron is alloyed with at least, by weight, about 4% additional elements, alternatively at least about 8% additional elements. Suitable additional elements include, but are not limited to, manganese, nickel, chromium, molybdenum, vanadium, silicon, boron, aluminum, cobalt, cerium, niobium, titanium, tungsten, tin, zinc, lead, and zirconium.

As used herein, "cobalt L-605" refers to an alloy including a composition, by weight, of about 20% chromium, about 10% nickel, about 15% tungsten, about 0.1% carbon, about 1.5% manganese, and a balance of cobalt. Cobalt L-605 is available from Special Metals Corporation, 3200 Riverside Drive, Huntington, W. Va. 25720.

As used herein, "CrMo steel" refers to a steel alloyed with at least chromium and molybdenum. In one embodiment, the CrMo steels are 41xx series steels as specified by the Society of Automotive Engineers.

As used herein, "CRUCIBLE 422" refers to an alloy including a composition, by weight, of about 11.5% chromium, about 1% molybdenum, about 0.23% carbon, about 0.75% manganese, about 0.35% silicon, about 0.8% nickel, about 0.25% vanadium, and a balance of iron. CRUCIBLE 422 is available from Crucible Industries LLC, 575 State Fair Boulevard, Solvay, N.Y., 13209.

As used herein, "INCONEL 718" refers to an alloy including a composition, by weight, of about 19% chromium, about 18.5% iron, about 3% molybdenum, about 3.6% niobium and tantalum, and a balance of nickel. INCONEL 718 is available from Special Metals Corporation, 3200 Riverside Drive, Huntington, W. Va. 25720.

As used herein, "INCONEL 738" refers to an alloy including a composition, by weight, of about 0.17% carbon, about 16% chromium, about 8.5% cobalt, about 1.75% molybdenum, about 2.6% tungsten, about 3.4% titanium, about 3.4% aluminum, about 0.1% zirconium, about 2% niobium, and a balance of nickel.

As used herein, "INCONEL X-750" refers to an alloy including a composition, by weight, of about 15.5% chromium, about 7% iron, about 2.5% titanium, about 0.7% aluminum, and about 0.5% niobium and tantalum, and a balance of nickel. INCONEL X-750 is available from Special Metals Corporation, 3200 Riverside Drive, Huntington, W. Va. 25720.

In one embodiment, the biasing force 128 is sufficient to dampen or eliminate contact and stresses between the inner shroud 102 and the outer shroud 104 generated by air loads and acoustic loads from the hot gas path 110 during operation.

The shroud dampening pin 106 may include an anti-rotation dampening tip 138 at the first end 122. In one embodiment, the inner shroud 102 includes an anti-rotation depression 140, the anti-rotation dampening tip 138 extends into the anti-rotation depression 140, and the anti-rotation dampening tip 138 mates non-rotatably with the anti-rotation depression 140. The anti-rotation dampening tip 138 may inhibit or eliminate circumferential motion of the inner shroud 102, rotation of the shroud dampening pin 106, or both.

The biasing apparatus 108 may be any suitable apparatus capable of providing the biasing force 128 through the shroud dampening pin 106 to the inner shroud 102. In one embodiment, the biasing apparatus 108 may be a springless biasing apparatus. As using herein, "springless" indicates the lack of a spring coil.

The pressurized fluid 126 may be supplied by any suitable source, including, but not limited to, a turbine compressor. The pressurized fluid 126 may include any suitable fluid, including, but not limited to, air. The pressurized fluid 126 may be maintained at a constant pressure during operation or may be adjustable during operation.

Referring to FIG. 1, in one embodiment, the biasing apparatus 108 includes a plug 142 disposed in the channel 112, a pin seal 144, and a pressurized cavity 146 disposed between the plug 142 and the shroud dampening pin 106. In a further embodiment, the pressurized fluid 126 directly exerts the biasing force 128 on the shroud dampening pin 106. In one embodiment, the plug 142 forms a seal for the pressurized cavity 146. In another embodiment, the biasing apparatus 108 further includes a plug seal 148 which forms a seal with the plug 142 for the pressurized cavity 146. The pin seal 144 may be disposed on the cap 120, the shaft 116, the channel 112 adjacent to the cap 120, the channel 112 adjacent to the shaft 116, or a combination thereof. The plug seal 148 may be disposed on the plug 142, may be disposed between the plug 142 and the pressurized cavity 146, may be disposed in the channel 112 adjacent to the plug 142, or a combination thereof.

Referring to FIG. 2, in one embodiment, the biasing apparatus 108 includes at least one bellows 200 configured to expand in response to an increased internal pressure within the at least one bellows 200 and to exert the biasing force 128. The bellows 300 may be secured in place by a plug 142, and the plug 142 may be threaded into the channel 112 to provide adjustability to the position of the bellows 200. The bellows 200 may be driven by the pressurized fluid 126. As used herein, "bellows" includes a pressurized bladder. The pressurized fluid 126 may enter the bellows 200 through an endplate 202 of the bellows 200. In one embodiment, a fluid channel 204 passes through the plug 142 and the endplate 202 into the bellows 200. The endplate 202 may be welded to the plug 142.

Referring to FIG. 3, in one embodiment, the biasing apparatus 108 includes at least one thrust piston 300 configured to translate toward the shroud dampening pin 106 in response to a pressurized fluid 126 and to exert the biasing force 128. A plug 142 may form a seal for the pressurized fluid 126 or may secure a seal for the pressurized fluid 126 in place. The thrust piston 300 includes a piston head 302, and may include a stanchion 304 attached to the piston head 302 and operating on the shroud dampening pin 106, or the piston head 302 may operate on the shroud dampening pin 106 directly without a stanchion 304 (not shown).

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A turbine shroud assembly, comprising:

an inner shroud arranged to be disposed adjacent to a hot gas path; and an outer shroud adjacent to the inner shroud and arranged to be disposed distal from the hot gas path across the inner shroud, the outer shroud including a channel extending from an aperture adjacent to the inner shroud;

a shroud dampening pin disposed within the channel and in contact with the inner shroud, the shroud dampening pin including:

a shaft disposed within the channel;

a contact surface disposed at a first end of the shaft and extending through the aperture in contact with the inner shroud; and a cap disposed at a second end of the shaft distal from the first end of the shaft; and a biasing apparatus in contact with the cap, the biasing apparatus being driven by a pressurized fluid and providing a biasing force away from the outer shroud along the shroud dampening pin to the inner shroud through the contact surface, wherein the inner shroud is in contact with but not fully secured to the outer shroud.

2. The turbine shroud assembly of claim 1, wherein the cap includes an extraction interface.

3. The turbine shroud assembly of claim 2, wherein the extraction interface includes a bore.

4. The turbine shroud assembly of claim 3, wherein the bore is a threaded bore.

5. The turbine shroud assembly of claim 1, wherein the shaft includes a circumferential relief groove directly adjacent to the cap.

6. The turbine shroud assembly of claim 1, wherein the inner shroud includes a composition selected from the group consisting of ceramic matrix composites (CMC), aluminum oxide-fiber-reinforced aluminum oxides (Ox/Ox), carbon-fiber-reinforced silicon carbides (C/SiC), silicon-carbide-fiber-reinforced silicon carbides (SiC/SiC), carbon-fiber-reinforced silicon nitrides ($C/Si_3N_4$), silicon-carbide-fiber-reinforced silicon nitrides ($SiC/Si_3N_4$), superalloys, nickel-based superalloys, cobalt-based superalloys, INCONEL 718, INCONEL X-750, cobalt L-605, and combinations thereof.

7. The turbine shroud assembly of claim 1, wherein the shroud dampening pin includes a material composition selected from the group consisting of high alloy steels, CrMo steels, superalloys, nickel-based superalloys, cobalt-based superalloys, cobalt L-605, CRUCIBLE 422, INCONEL 718, INCONEL X-750, and combinations thereof.

8. The turbine shroud assembly of claim 1, further including a plurality of shroud dampening pins disposed within a plurality of channels.

9. The turbine shroud assembly of claim 1, wherein the biasing force is sufficient to dampen or eliminate contact and stresses between the inner shroud and the outer shroud generated by air loads and acoustic loads from the hot gas path during operation.

10. The turbine shroud assembly of claim 1, wherein the shroud dampening pin includes an anti-rotation dampening tip at the first end.

11. The turbine assembly of claim 10, wherein the inner shroud includes an anti-rotation depression, the anti-rotation dampening tip extends into the anti-rotation depression, and the anti-rotation dampening tip mates non-rotatably with the anti-rotation depression.

12. The turbine shroud assembly of claim 10, wherein the anti-rotation dampening tip inhibits circumferential motion of the inner shroud.

13. The turbine shroud assembly of claim 10, wherein the anti-rotation dampening tip inhibits rotation of the anti-rotation shroud dampening pin.

14. The turbine shroud assembly of claim 1, wherein the biasing apparatus is a springless biasing apparatus.

15. The turbine shroud assembly of claim 1, wherein the pressurized fluid is provided by a turbine compressor.

16. The turbine shroud assembly of claim 1, wherein a pressure of the pressurized fluid is adjustable during operation.

17. The turbine shroud assembly of claim 1, wherein the biasing apparatus includes a plug disposed in the channel, a pin seal, and a pressurized cavity disposed between the plug and the shroud dampening pin, and the pressurized fluid directly exerts the biasing force on the shroud dampening pin.

18. The turbine shroud assembly of claim 17, wherein the biasing apparatus further includes a plug seal.

19. The turbine shroud assembly of claim 1, wherein the biasing apparatus includes at least one bellows configured to expand in response to an increased internal pressure within the at least one bellows and to exert the biasing force.

20. The turbine shroud assembly of claim 1, wherein the biasing apparatus includes at least one thrust piston configured to exert the biasing force.

* * * * *